US007874040B2

(12) United States Patent
Follows et al.

(10) Patent No.: US 7,874,040 B2
(45) Date of Patent: Jan. 25, 2011

(54) CYCLONIC SEPARATING APPARATUS

(75) Inventors: Thomas James Dunning Follows, Malmesbury (GB); Andrew Phillip Stokes, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 179 days.

(21) Appl. No.: 12/259,814

(22) Filed: Oct. 28, 2008

(65) Prior Publication Data

US 2009/0113663 A1 May 7, 2009

(30) Foreign Application Priority Data

Nov. 1, 2007 (GB) ..... 0721468.7

(51) Int. Cl.
*A47L 9/16* (2006.01)

(52) U.S. Cl. ..... 15/347; 15/353; 15/352

(58) Field of Classification Search ..... 15/347, 15/352, 353, 447, 345, 346, 343
See application file for complete search history.

(56) References Cited

U.S. PATENT DOCUMENTS

| | | | | |
|---|---|---|---|---|
| 5,078,761 | A | 1/1992 | Dyson | |
| 5,090,976 | A * | 2/1992 | Dyson | 55/337 |
| 7,618,470 | B2 * | 11/2009 | Eddington et al. | 55/337 |
| 7,731,770 | B2 * | 6/2010 | Strutt et al. | 55/337 |
| 2006/0059871 | A1 * | 3/2006 | Han et al. | 55/345 |
| 2006/0075728 | A1 * | 4/2006 | Oh et al. | 55/345 |

FOREIGN PATENT DOCUMENTS

| | | | |
|---|---|---|---|
| EP | 0 042 723 | | 12/1981 |
| EP | 0 800 360 | A1 | 10/1997 |
| EP | 1 268 076 | B1 | 1/2003 |
| EP | 1 370 173 | A1 | 12/2003 |
| EP | 1 377 196 | A1 | 1/2004 |
| EP | 1 786 568 | A1 | 5/2007 |
| GB | 2360719 | | 10/2001 |
| GB | 2 367 510 | A | 4/2002 |

(Continued)

OTHER PUBLICATIONS

International Search Report and Written Opinion mailed on Feb. 5, 2009 directed at counterpart application No. PCT/GB2008/003541;14 pages.

(Continued)

*Primary Examiner*—Dung Van Nguyen
(74) *Attorney, Agent, or Firm*—Morrison & Foerster LLP

(57) ABSTRACT

A cyclonic separating apparatus includes a cyclonic separator for separating dirt and dust from an airflow, an inlet to the cyclonic separator and a shroud comprising a wall having a multiplicity of through-holes forming an outlet from the cyclonic separator. The apparatus also includes a plurality of separate passageways provided immediately downstream of the through-holes. By providing this arrangement, the separate passageways can be located around other parts of the cyclonic separating apparatus inwardly of the shroud, allowing for better packaging of the components of the cyclonic separating apparatus. The shroud may be reduced in size because some of the space previously required for a single, large passageway can be used for other components of the cyclonic separating apparatus such a collector or a cyclone. The reduction in size of the shroud in turn allows for the cyclonic separating apparatus to be more compact.

21 Claims, 6 Drawing Sheets

FOREIGN PATENT DOCUMENTS

| | | | |
|---|---|---|---|
| GB | 2 407 784 | | 5/2005 |
| GB | 2 416 721 | A | 2/2006 |
| GB | 2416721 | | 2/2006 |
| GB | 2 417 702 | A | 3/2006 |
| GB | 2 440 125 | A | 1/2008 |
| WO | WO-96/19937 | | 7/1996 |
| WO | WO-01/74493 | A1 | 10/2001 |
| WO | WO-02/067754 | A1 | 9/2002 |
| WO | WO-02/082966 | A1 | 10/2002 |
| WO | WO-2006/010881 | A1 | 2/2006 |
| WO | WO-2006/026414 | | 3/2006 |
| WO | WO-2006/125944 | A1 | 11/2006 |

OTHER PUBLICATIONS

GB Search Report, dated Feb. 22, 2008, directed to counterpart GB Patent Application No. 0721468.7; 2 pages.

* cited by examiner

CYCLONIC SEPARATING APPARATUS

REFERENCE TO RELATED APPLICATION

This application claims the priority of United Kingdom Application No. 0721468.7, filed Nov. 1, 2007, the contents of which are incorporated herein by reference.

FIELD OF THE INVENTION

The present invention relates to cyclonic separating apparatus. Particularly, but not exclusively, the present invention relates to cyclonic separating apparatus for a vacuum cleaner.

BACKGROUND OF THE INVENTION

Vacuum cleaners which utilise cyclonic separators are well known. Examples of such vacuum cleaners are shown in EP 0 042 723, EP 1 370 173 and EP 1 268 076. In general, an airflow in which dirt and dust is entrained enters a first cyclonic separator via a tangential inlet which causes the airflow to follow a spiral or helical path within the first cyclonic separator so that the dirt and dust is separated from the airflow. Relatively clean air passes out of the first cyclonic separator while the separated dirt and dust is collected therein. In some applications, and as described in EP 0 042 723, the airflow is then passed to a second cyclonic separator which is capable of separating finer dirt and dust than the first cyclonic separator.

However, a common problem is that larger particles of dirt and dust (for example, fluff or hair) not separated by the first cyclonic separator are able to pass into the second cyclonic separator, resulting in potential blockages and a loss of separation efficiency. Therefore, it has been found useful to position a barrier member, known as a shroud, in the airflow path between the first cyclonic separator and the second cyclonic separator. An example of a typical shroud is shown in EP 0 800 360.

A shroud typically includes a wall having a large number of through-holes which communicate on their upstream side with the first cyclonic separator. The through-holes of the shroud thus form an outlet from the first cyclonic separator. In use, the through-holes of the shroud prevent larger particles of dirt and dust from passing therethrough. However, smaller particles of dirt and dust not separated by the first cyclonic separator pass through the through-holes in the shroud and into a passageway leading to the inlet to the second cyclonic separator.

EP 1 377 196 describes a passageway in the form of an annular passageway located downstream of a shroud. Baffles are located in the annular passageway remote from the shroud to divide the airflow between a plurality of cyclones which form the second cyclonic separator.

An alternative passageway arrangement is shown in EP 1 786 568, which discloses a shroud for a vacuum cleaner having two cyclonic separators. The shroud forms an outlet from the first cyclonic separator, and a passageway is located downstream of the shroud. A plurality of baffles is located on the inner surface of the shroud in the passageway. The passageway forms a communication path between the shroud and the inlets to a plurality of cyclones forming part of a second cyclonic separator. The bodies of the cyclones extend through the passageway and into a collector located below the passageway. Such an arrangement is well known for cyclonic separating apparatus having two cyclonic separators.

However some, more recent, vacuum cleaners include cyclonic separating apparatus which has more than two cyclonic separators or separation stages. Cyclonic separating apparatus including three cyclonic separators is disclosed in WO 2006/125944. In the arrangement described therein, three collectors for dirt and dust are provided—one for each cyclonic separator.

In such an arrangement, the increased number of cyclonic separators and collectors reduce the space available for the passageway downstream of the shroud. To provide sufficient space to accommodate the passageway, the diameter of the shroud may be increased, leading to an undesirable increase in the overall size of the cyclonic separating apparatus.

SUMMARY OF THE INVENTION

It is an object of the present invention to provide cyclonic separating apparatus which is more compact than known arrangements. It is a further object of the invention to provide an arrangement of passageways within a cyclonic separating apparatus which allow more efficient use of space when compared to known arrangements.

According to the invention, there is provided cyclonic separating apparatus comprising a cyclonic separator for separating dirt and dust from an airflow, an inlet to the cyclonic separator and a shroud comprising a wall having a multiplicity of through-holes forming an outlet from the cyclonic separator, wherein a plurality of separate passageways are provided immediately downstream of the through-holes.

By providing such an arrangement, the separate passageways can be located around other parts of the cyclonic separating apparatus inwardly of the shroud, allowing for better packaging of the components of the cyclonic separating apparatus. This allows the shroud to be reduced in size because some of the space previously required for a single, large passageway can be used for other components of the cyclonic separating apparatus; for example, a collector or a cyclone. The reduction in size of the shroud in turn allows for the cyclonic separating apparatus to be more compact.

Further, the above arrangement reduces the likelihood of larger particles of dirt and dust causing blockages downstream of the shroud. This is because the provision of a plurality of separate passageways immediately downstream of the shroud reduces stagnation of the airflow downstream of the shroud. Therefore, there is less opportunity for larger particles of dirt and dust to build up in the region immediately downstream of the shroud.

Preferably, the passageways are arranged around the inner circumference of the shroud. This arrangement allows the inner surface of the shroud to form a part of the passageways, which reduces the length of the passageway and the amount of material required to form the passageway. Both of the above help to reduce the size of the cyclonic separating apparatus.

Preferably, the through-holes are arranged in a plurality of separate groups, each group corresponding to a single passageway. By arranging the through-holes in a plurality of groups, the passageways can be kept separate from one another while still in communication with the optimum number of through-holes.

Preferably, a further cyclonic separator is provided downstream of the cyclonic separator. More preferably, the further cyclonic separator has a collection area for collecting separated dirt and dust and a plurality of channels connecting the further cyclonic separator with the collection area. More preferably, the collection area and the plurality of channels form a collector for the further cyclonic separator.

Preferably, the channels are located between adjacent passageways. This arrangement is compact and uses the available space effectively.

Preferably, a common wall separates the passageways from the channels. By providing a common wall between the channels and the passageways, the structure is simplified, space is saved and manufacturing costs are reduced.

Preferably, the passageways communicate with an inlet to the further cyclonic separator.

Preferably, an intermediate cyclonic separator is provided downstream of the cyclonic separator and upstream of the further cyclonic separator. An additional stage of cyclonic cleaning is useful to improve the overall separation efficiency of the cyclonic separating apparatus.

Preferably, the intermediate cyclonic separator is located inwardly of the passageways.

This arrangement is compact and makes best use of the available space inwardly of the shroud.

Preferably, the passageways communicate with an inlet to the intermediate cyclonic separator. More preferably, a duct is located upstream of the inlet to the intermediate cyclonic separator, the duct being in communication with each of the passageways.

BRIEF DESCRIPTION OF THE DRAWINGS

An embodiment of the invention will now be described with reference to the accompanying drawings, in which.

DETAILED DESCRIPTION OF THE INVENTION

Figure 1:
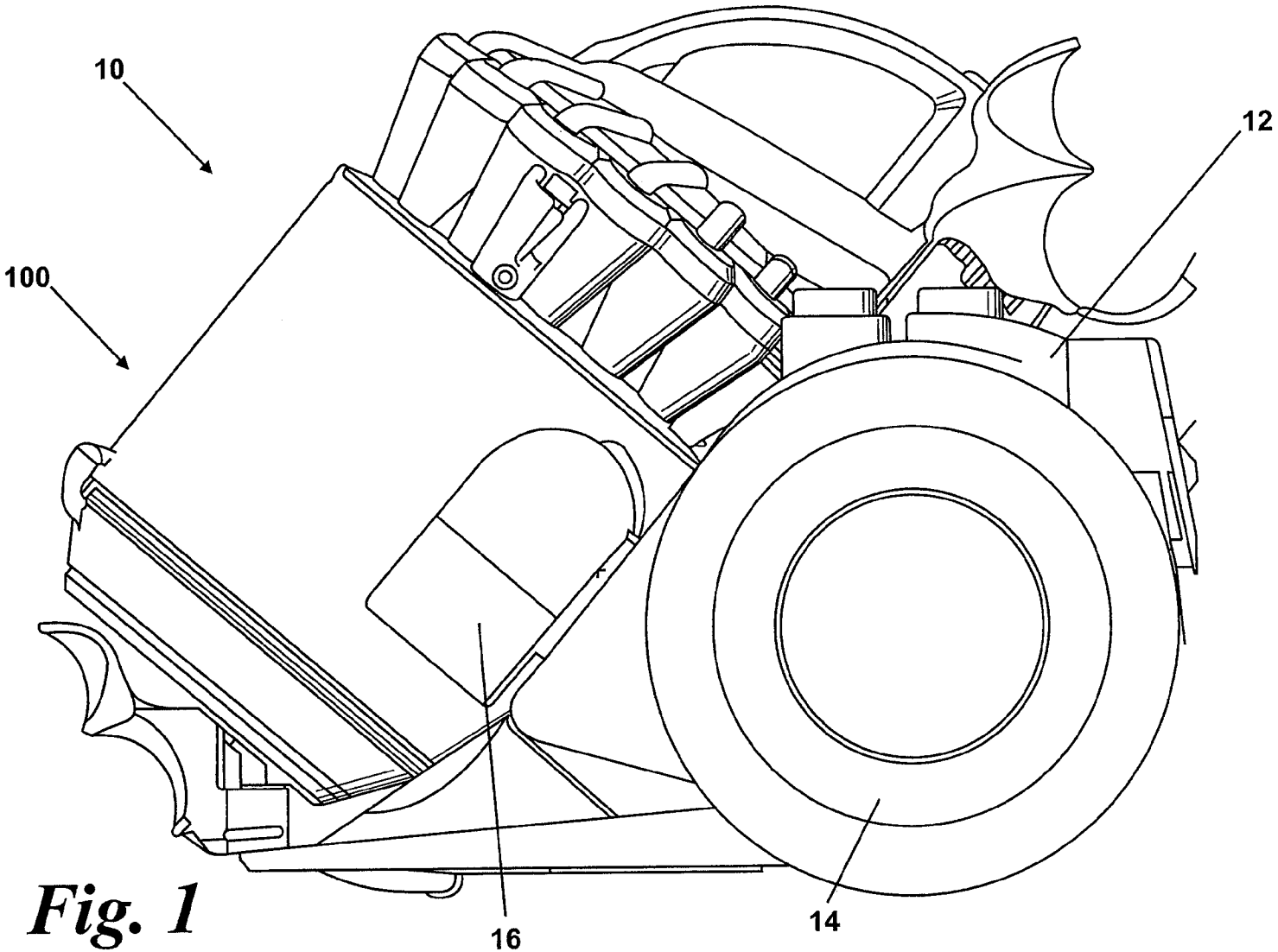
FIG. 1 is a side view of a cylinder vacuum cleaner including cyclonic separating apparatus according to the invention.
Figure 2:
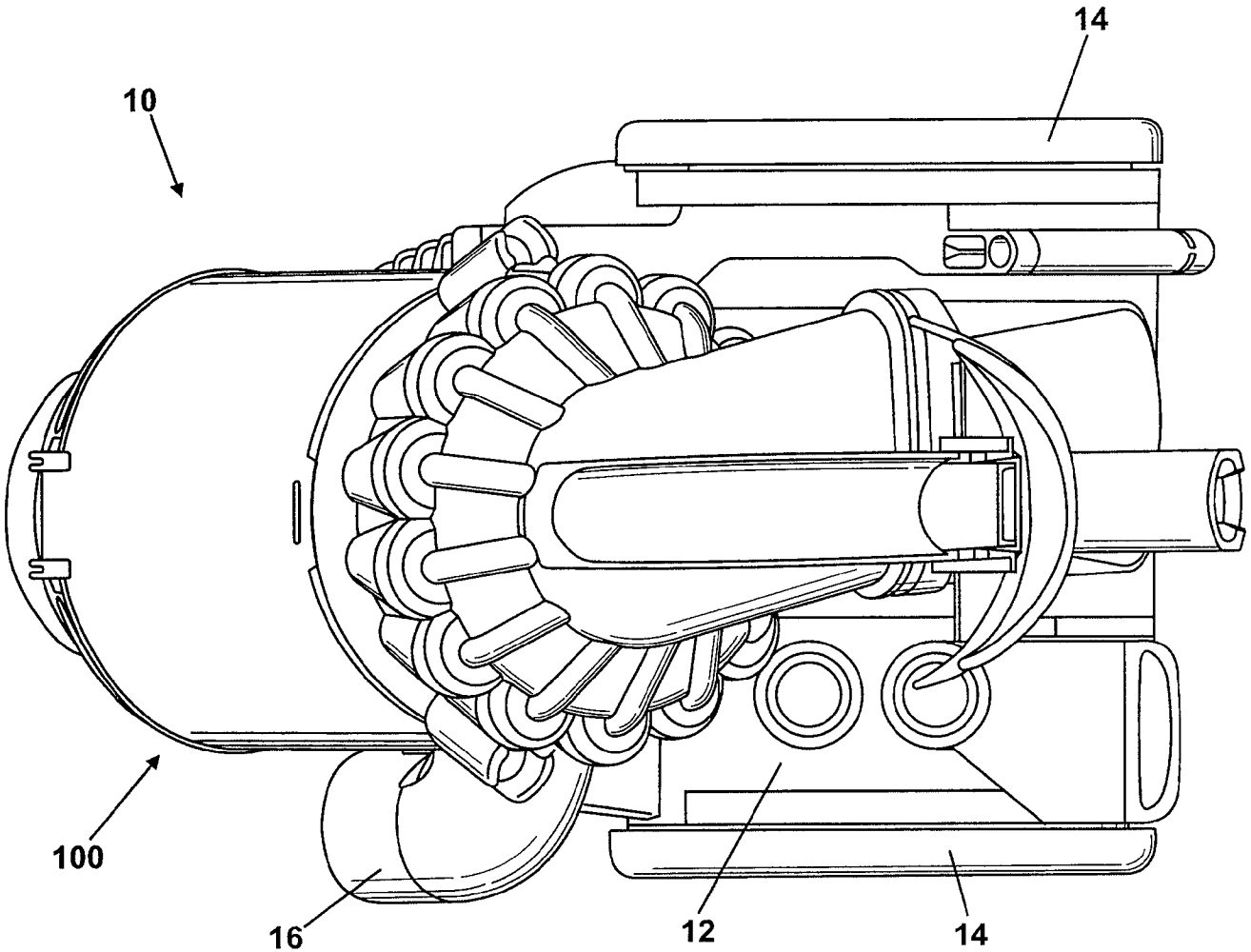
FIG. 2 is a plan view of the cylinder vacuum cleaner of FIG. 1.

A cylinder vacuum cleaner 10 incorporating cyclonic separating apparatus according to the invention is shown in FIGS. 1 and 2. The vacuum cleaner 10 has a main body 12 housing a motor and fan unit (not shown) and to which a pair of wheels 14 is attached. The wheels 14 allow the main body 12 of the vacuum cleaner 10 to be maneuvered across a floor surface. A dirty air inlet 16 is formed on the main body 12. A hose and wand assembly (not shown) can be connected to the dirty air inlet 16 in order to enable a user to clean a floor surface.

Cyclonic separating apparatus 100 according to the invention is releasably attached to the main body 12. The interior of the cyclonic separating apparatus 100 is in communication with the dirty air inlet 16 through which a dirt-laden airflow enters the cyclonic separating apparatus 100. The cyclonic separating apparatus 100 can be removed from the main body 12 for emptying purposes.

The cyclonic separating apparatus 100 is shown in more detail in FIGS. 3 to 6, in which the cyclonic separating apparatus 100 is shown removed from the remainder of the vacuum cleaner 10 for clarity. Firstly referring to FIG. 3, the cyclonic separating apparatus 100 comprises an upper portion 102 and a lower portion 104. The upper and lower portions 102, 104 are separable from one another to allow parts of the cyclonic separating apparatus 100 to be cleaned. The upper portion 102 includes a handle 106 for carrying the cyclonic separating apparatus 100. The handle 106 can also be used to carry the entire vacuum cleaner 10 if the cyclonic separating apparatus 100 is attached thereto.

The lower portion 104 has a substantially cylindrical outer wall 108 and a base 110. The outer wall 108 and the base 110 delimit a first cyclonic separator 112 and a first collector 114. Dirt and dust is separated by the first cyclonic separator 112 and collected in the first collector 114. An inlet 116 is formed in the outer wall 108. The inlet 116 forms a communication path between the dirty air inlet 16 and the interior of the first cyclonic separator 112. The air inlet 116 is arranged tangentially to the first cyclonic separator 112 so that the incoming air is forced to follow a helical path around the interior of the outer wall 108. The base 110 is openable for emptying purposes. The base 110 is pivoted about a hinge 118 and held in place by a catch 120.

A shroud 122 is located inwardly of the outer wall 108 of the first cyclonic separator 112. The shroud 122 comprises a wall 124 having a cylindrical lower part and a tapered upper part. A plurality of through-holes 126 is formed in the wall 124 and forms an outlet from the first cyclonic separator 112. The through-holes 126 are arranged in a plurality of groups 128 spaced around the circumference of the wall 124. A lip 130 is provided at the base of the shroud 122 and depends therefrom. The lip 130 includes a plurality of through-holes 132 arranged in rows around the circumference thereof. The lip 130 helps to prevent separated dirt and dust from being re-entrained back into the airflow within the first cyclonic separator 112.

Figure 4:
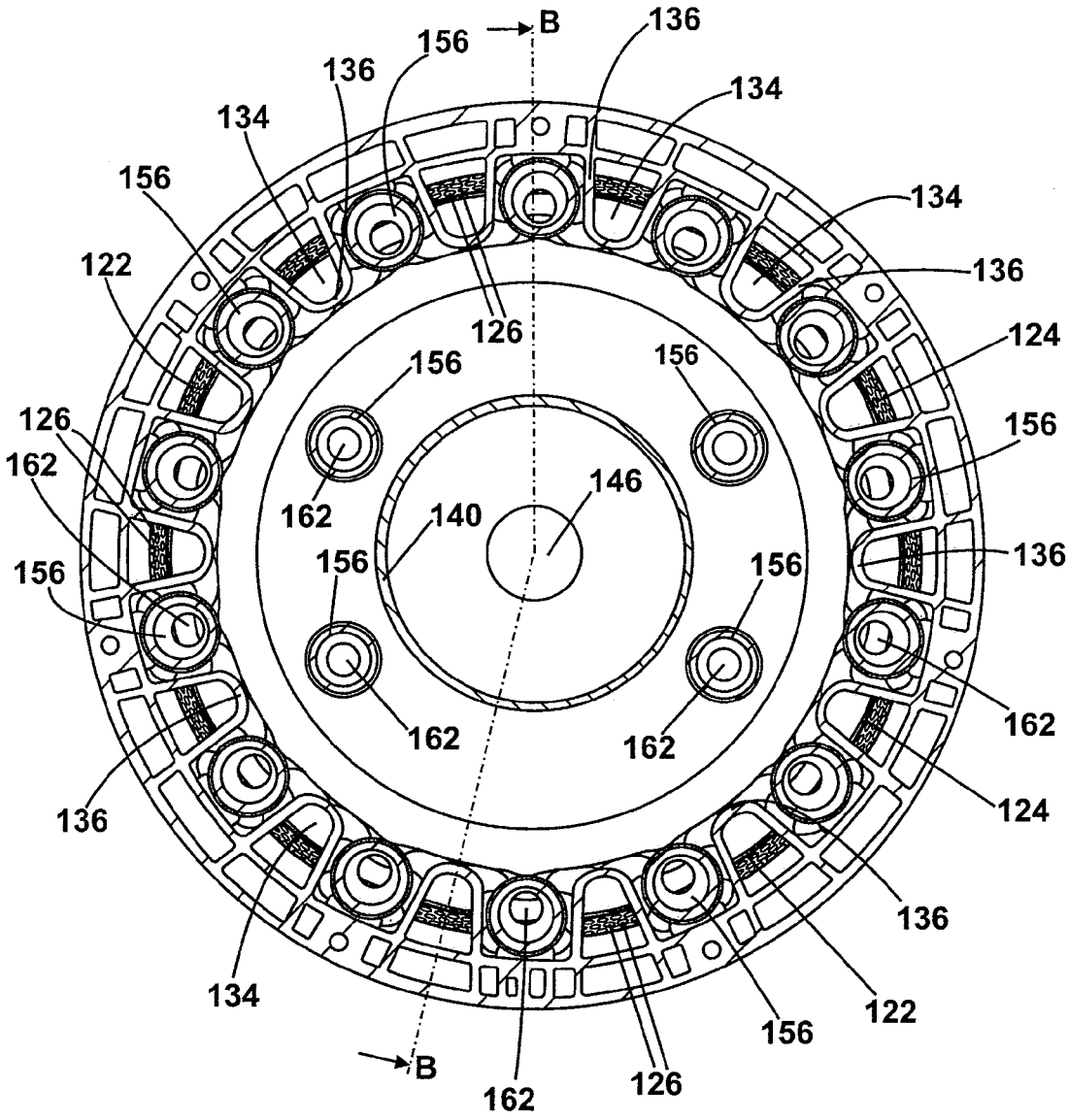
FIG. 4 is a section through the cyclonic separating apparatus of FIG. 3 taken along the line A-A of FIG. 3.
Figure 5:
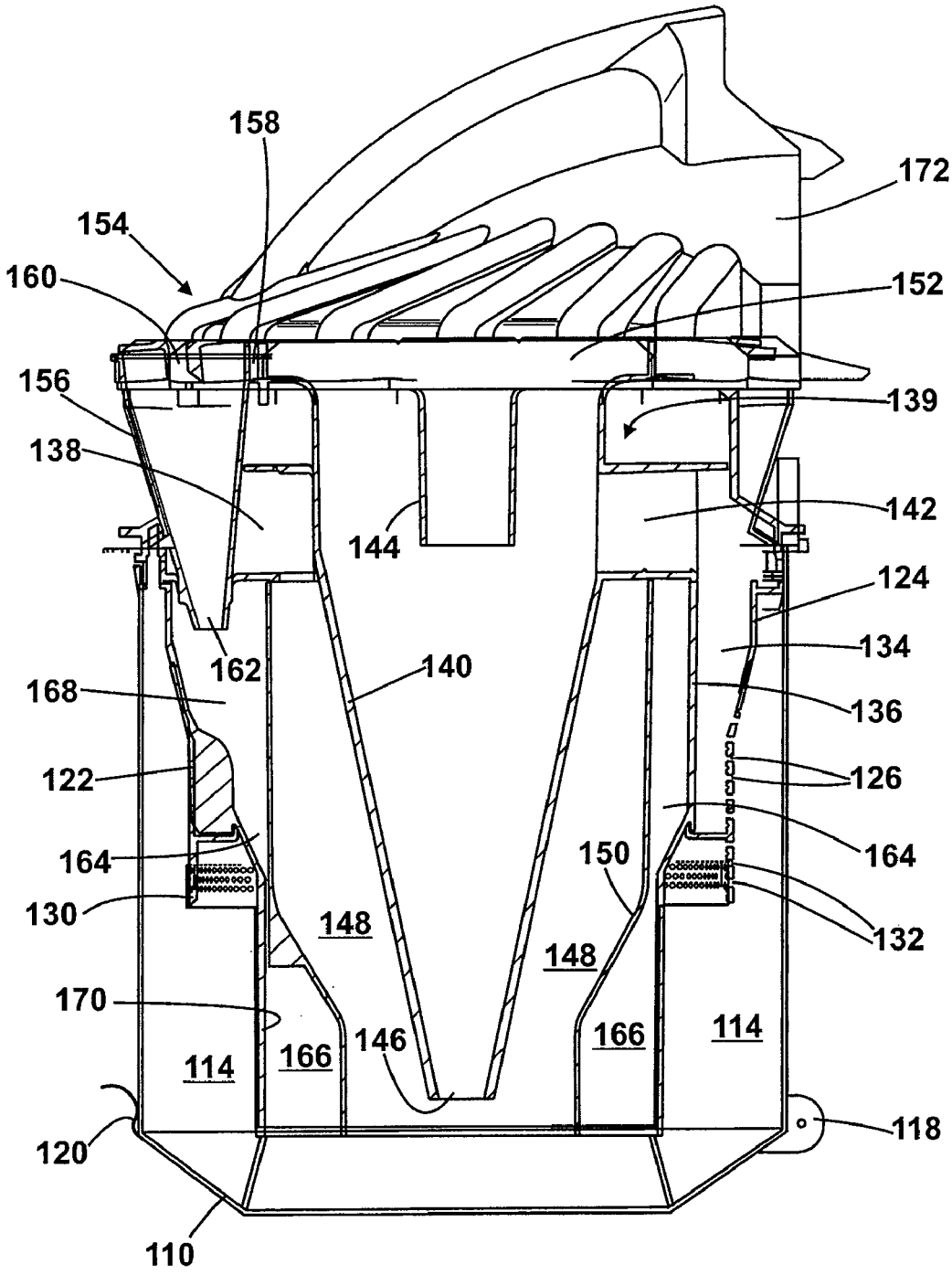
FIG. 5 is a side section through the cyclonic separating apparatus of FIG. 3 taken along the line B-B of FIG. 4.
Figure 6:
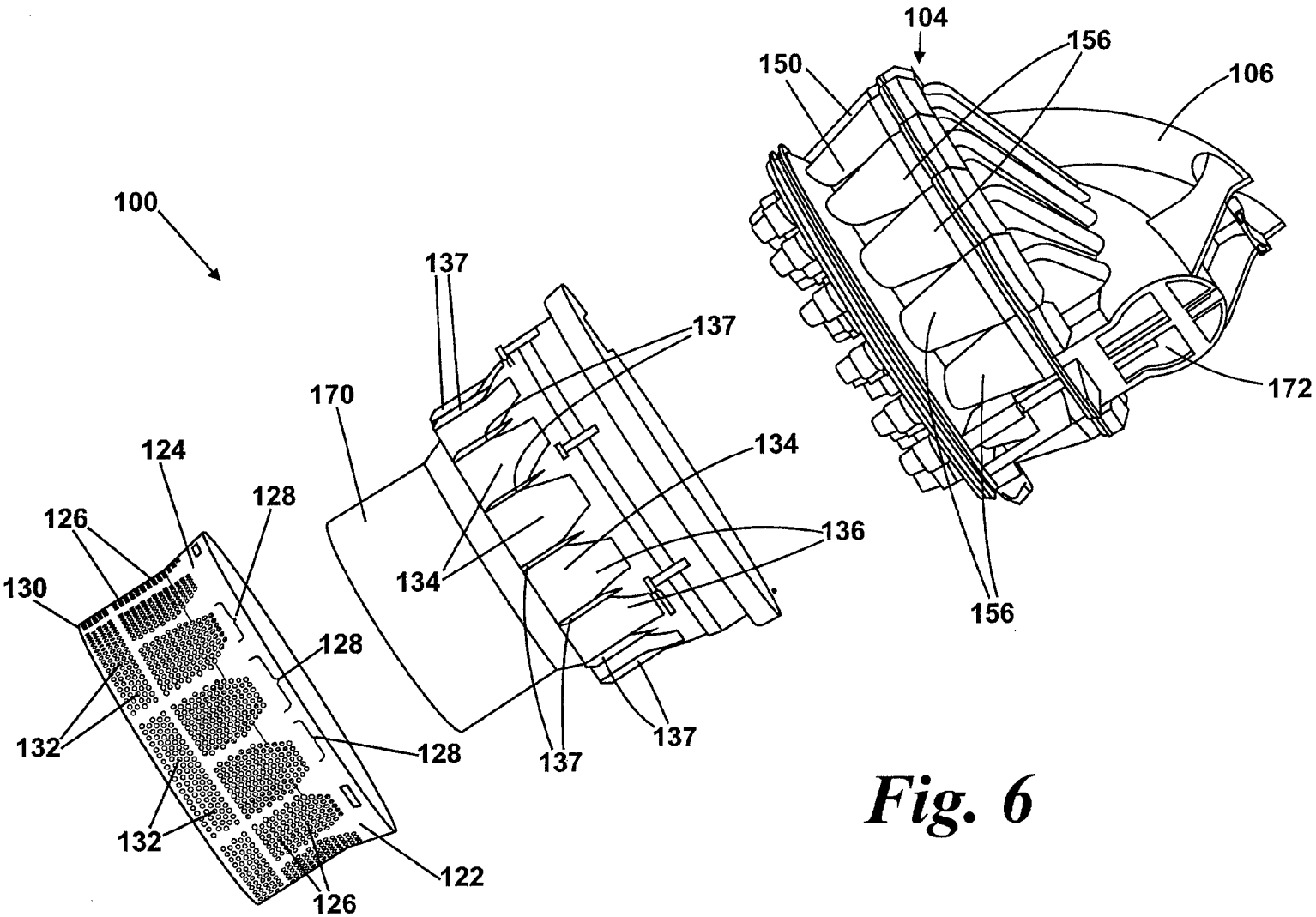
FIG. 6 is an exploded view of parts of the cyclonic separating apparatus of FIG. 3.

Referring now to FIGS. 4 to 6, a plurality of passageways 134 are formed immediately downstream of the through-holes 126. Each passageway 134 corresponds to a single group 128 of through-holes 126 and is delimited by the inner surface of the wall 124 of the shroud 122 and a passageway wall 136. The passageways 134 are spaced around the inner circumference of the shroud 122. This is best shown in FIG. 4. A partition 137 is located on either side of each passageway 134 at a lower end thereof (see FIG. 6). Therefore, the lower end of each passageway 134 is separated from an adjacent passageway 134 by a partition 137. This is shown most clearly in FIG. 6. The passageways 134 extend upwards away from the through-holes 126 and become narrower but deeper in the downstream direction. In other words, in the downstream direction, the passageways 134 reduce in width in a circumferential direction but increase in depth in a radial direction. This can be seen most clearly in FIGS. 5 and 6. In this embodiment, the minimum depth of the passageways 134 in a radial direction is 8.5 mm.

A duct 138 (FIG. 5) is located at the upper end of the passageways 134. The duct 138 is an annular space which is in communication with each passageway 134. The duct 138 provides a communication path between the passageways 134 and a second cyclonic separator 139. The duct 138 allows the individual airflow paths from the passageways 134 to be recombined before passing into the second cyclonic separator 139. This arrangement helps to keep the pressure of the air entering the second cyclonic separator 139 more constant. The second cyclonic separator 139 comprises a single cyclone 140 located inwardly of the passageways 134. The single cyclone 140 has an air inlet 142 and an air outlet 144, both of which are located at a first end of the single cyclone 140. A cone opening 146 is located at a second end of the single cyclone 140.

A second collector 148 is also located at the second end of the single cyclone 140 and is in communication with the cone opening 146. The second collector 148 is delimited by a wall 150 which depends from an outer surface of a wall delimiting the duct 138 and which is located inwardly of the shroud 122 and the passageway walls 136. The air outlet 144 of the single cyclone 140 is in communication with a duct 152. The duct 152 provides a communication path between the second cyclonic separator 139 and a third cyclonic separator 154. Therefore, the second cyclonic separator 139 acts as an intermediate cyclonic separator between the low-efficiency first cyclonic separator 112 and a high-efficiency third cyclonic separator 154.

Figure 3:
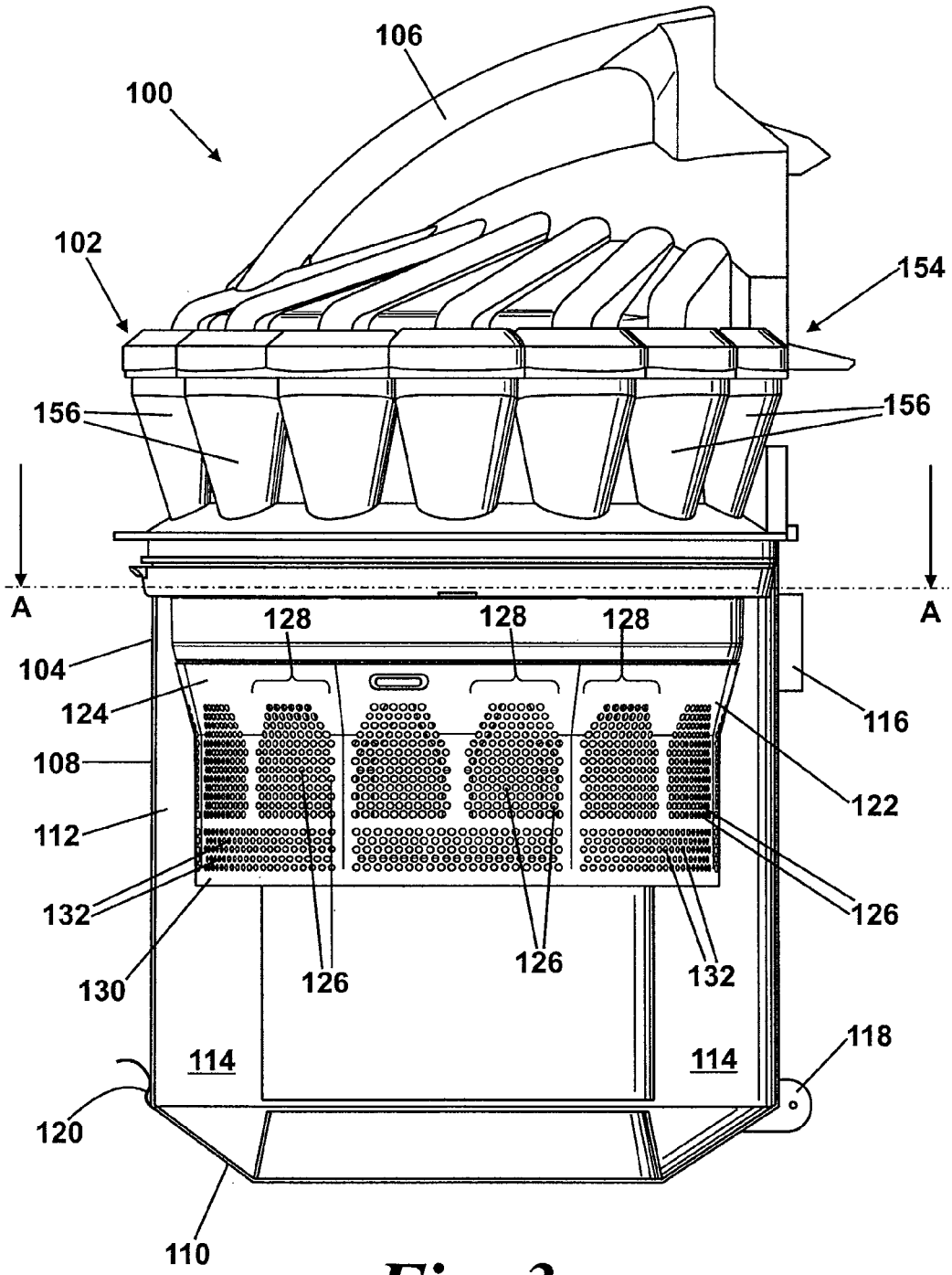
FIG. 3 is a side view of the cyclonic separating apparatus removed from the remainder of the cylinder vacuum cleaner of FIG. 1.

The third cyclonic separator 154 comprises a plurality of high-efficiency cyclones 156 arranged in parallel. In this embodiment, eighteen high-efficiency cyclones 156 are provided. Fourteen high-efficiency cyclones 156 are arranged in a ring around the outer circumference of the upper part 102 of the cyclonic separating apparatus 100. A part of each of the high-efficiency cyclones 156 in this ring forms a part of the outer surface of the cyclonic separating apparatus 100, as shown in FIGS. 3 and 5. The remaining four high-efficiency cyclones 156 (shown in FIG. 4) are located inwardly of the ring of fourteen high-efficiency cyclones 156. Each high-efficiency cyclone 156 has a tangentially-arranged air inlet 158 and an air outlet 160. Each air inlet 158 and air outlet 160 is located at a first end of the respective high-efficiency cyclone 156. A cone opening 162 is located at a second end of each high-efficiency cyclone 156.

A third collector 164 is located at the second end of the high-efficiency cyclones 156 and is in communication with the cone openings 162 of the high-efficiency cyclones 156. The third collector 164 comprises an annular base portion 166 and a plurality of connecting channels 168. The base portion 166 acts as a collection area for separated dirt and dust and is delimited by a cylindrical wall 170 and the outer surface of wall 150. The channels 168 provide a communication path between each of the cone openings 162 and the base portion 166. Each channel 168 corresponds to a single high-efficiency cyclone 156 and is delimited by the outer surfaces of the passageway walls 136 and the wall 150. Therefore, the passageways 134 and channels 168 are separated from one another by the passageway walls 136. This is shown most clearly in FIG. 4. The channels 168 and passageways 134 are arranged alternately around the inner circumference of wall 124 so that the channels 168 are located between adjacent passageways 134. This arrangement is advantageous because both the passageways 134 and the channels 168 can be accommodated in one annular space, without the need to increase the diameter of the wall 124 of the shroud 122.

As shown in FIG. 4, a part of each high-efficiency cyclone 156 in the ring of fourteen high-efficiency cyclones 156 is also located between adjacent passageways 134. In this embodiment, the cone opening 162 of each of the high-efficiency cyclones 156 in the ring is spaced from a respective passageway wall 136 by a distance approximately equal to the diameter of the cone opening 162 in order to reduce the risk of re-entrainment of dirt and dust separated by the high-efficiency cyclones 156 back into the airflow leaving the third cyclonic separator 154.

The air outlets 160 of the high-efficiency cyclones 156 are in communication with an outlet 172. The outlet 172 provides an airflow path from the cyclonic separating apparatus 100 into other parts of the vacuum cleaner 10. Located downstream of the outlet 172 is a pre-motor filter (not shown), the motor and fan unit and a post-motor filter (not shown).

In use, the motor and fan unit draws a flow of dirt-laden air through the hose and wand, into the dirty air inlet 16, through the inlet 116 and into the cyclonic separating apparatus 100. Due to the tangential arrangement of the inlet 116, the airflow is forced to follow a helical path around the interior of the outer wall 108. Therefore, larger dirt and dust particles are separated by cyclonic motion in the first cyclonic separator 112. These particles are collected in the first collector 114.

The partially-cleaned airflow then flows back up the interior of the first cyclonic separator 112 and exits the first cyclonic separator 112 via the through-holes 126 in the shroud 122. Once the airflow has passed through the through-holes 126, it is divided between the plurality of passageways 134 immediately downstream of the through-holes 126. The airflow moves up the passageways 134 and passes into the duct 138 whereupon the airflows from each of the passageways 134 are re-combined. The airflow then moves from the duct 138 into the inlet 142 of the single cyclone 140 of the second cyclonic separator 139. The single cyclone 140 has a diameter smaller than the outer wall 108 of the first cyclonic separator 112 and is tapered. Therefore, the single cyclone 140 is able to separate smaller particles of dirt and dust from the partially-cleaned airflow than the first cyclonic separator 112. Separated dirt and dust exits the single cyclone 140 via the cone opening 146 and is collected in the second collector 148. The cleaned air then flows back up the centre of the single cyclone 140, exits the single cyclone 140 through the air outlet 144 and passes into the duct 152.

From duct 152, the airflow is then divided between the tangential air inlets 158 of the eighteen high-efficiency cyclones 156 of the third cyclonic separator 154. Each of the high-efficiency cyclones 156 has a diameter smaller than that of both the first cyclonic separator 112 and the single cyclone 140 of the second cyclonic separator 139. Therefore, the high-efficiency cyclones 156 are able to separate even finer particles of dirt and dust from the airflow than either of the first or second cyclonic separators 112, 138. Separated dirt and dust exits the high-efficiency cyclones 156 via the cone openings 162 and passes into the third collector 164. Once in the third collector 164, the separated dirt and dust passes down the channels 168 and is collected in the base portion 166.

Cleaned air then flows back up the high-efficiency cyclones 156, exits the high-efficiency cyclones 156 through the air outlets 160 and enters the outlet 172. The cleaned air then passes from the outlet 172 sequentially through the pre-motor filter, the motor and fan unit, and the post-motor filter before being exhausted from the vacuum cleaner 10 through air vents (not shown) located on the outer surface of the vacuum cleaner 10.

When a cleaning operation is finished, the collectors 114, 148, 164 of the cyclonic separating apparatus 100 may be full of dirt and dust, and require emptying. To do this, the user switches off the vacuum cleaner 10 and removes the cyclonic separating apparatus 100 from the main body 12 by pressing a release catch (not shown). Using the handle 106, the user then places the cyclonic separating apparatus 100 over a suitable receptacle such as a dustbin and presses a further release button (not shown) in order to release the base 110.

When released, the base 110 pivots downwardly about the hinge 112 so that the dirt and dust collected in the first, second and third collectors 114, 148, 164 can thus be emptied conveniently and efficiently. The first, second and third collectors 114, 148, 164 are emptied simultaneously during this process.

When the cyclonic separating apparatus 100 has been emptied as described above, the user manually moves the base 110 back into the closed position shown in FIG. 3. The cyclonic separating apparatus 100 can then be replaced on the main body 12 of the vacuum cleaner 10 (as shown in FIGS. 1 and 2) for further cleaning operations.

The invention is not limited to the detailed description given above. Variations will be apparent to the person skilled in the art. For example, the passageways need not be arranged around the entirety of the inner circumference of the shroud. They may be arranged only around a part of the inner circumference of the shroud. Alternative arrangements, such as spiral passageways or rows of passageways could also be used.

Additionally, the through-holes in the shroud need not be arranged in a plurality of groups. The through-holes may be arranged in rows or columns, with each passageway corresponding to a row, a column or a part thereof.

Any number of cyclonic separators may be provided. For example, a single cyclonic separator may be provided with, optionally, a filter or other separating media downstream of the shroud. Alternatively, two cyclonic separators may be provided in series. Any number of cyclones may be used in each cyclonic separator. Additionally, any number of collectors could be used to collect separated dirt and dust.

The channels, although preferred, are not essential to the invention. Further, if channels are provided, they need not form part of the third collector. They may form part of the first or second collectors, or may take the form of a plurality of conduits which lead into a separate collector.

The cleaning appliance need not be a cylinder vacuum cleaner. The invention is applicable to other types of vacuum cleaner, for example, upright machines, stick-vacuums or hand-held cleaners. Further, the present invention is applicable to other types of cleaning appliances, for example, a wet and dry machine or a carpet shampooer.

The invention claimed is:

1. A cyclonic separating apparatus, comprising:

a cyclonic separator for separating dirt and dust from an airflow, an inlet to the cyclonic separator and a shroud comprising a wall having a plurality of through-holes forming an outlet from the cyclonic separator;

a plurality of separate passageways provided immediately downstream of the through-holes; and a further cyclonic separator provided downstream of the cyclonic separator and comprising a plurality of cyclones in parallel, wherein at least a part of each cyclone of the further cyclonic separator lies between adjacent passageways.

2. The cyclonic separating apparatus of claim 1, wherein the passageways are arranged around the inner circumference of the shroud.

3. The cyclonic separating apparatus of claim 1 or 2, wherein the through-holes are arranged in a plurality of separate groups, each group corresponding to a single passageway.

4. The cyclonic separating apparatus of claim 3, comprising a further cyclonic separator provided downstream of the cyclonic separator.

5. The cyclonic separating apparatus of claim 1, wherein at least a part of each cyclone of the further cyclonic separator lies between adjacent passageways.

6. The cyclonic separating apparatus of claim 1, wherein the further cyclonic separator has a collection area for collecting separated dirt and dust and a plurality of channels for connecting the further cyclonic separator with the collection area.

7. The cyclonic separating apparatus of claim 6, wherein the collection area and the plurality of channels form a collector for the further cyclonic separator.

8. The cyclonic separating apparatus of claim 7, further comprising an intermediate cyclonic separator provided downstream of the cyclonic separator and upstream of the further cyclonic separator.

9. The cyclonic separating apparatus of claim 6, wherein the channels are located between adjacent passageways.

10. The cyclonic separating apparatus of claim 6, wherein a common wall separates the passageways from the channels.

11. The cyclonic separating apparatus of claim 10, further comprising an intermediate cyclonic separator provided downstream of the cyclonic separator and upstream of the further cyclonic separator.

12. The cyclonic separating apparatus of claim 6, further comprising an intermediate cyclonic separator provided downstream of the cyclonic separator and upstream of the further cyclonic separator.

13. The cyclonic separating apparatus of claim 1, wherein the passageways communicate with an inlet to the further cyclonic separator.

14. A cleaning appliance comprising incorporating the cyclonic separating apparatus of claim 1.

15. A vacuum cleaner comprising the cleaning appliance of claim 14.

16. A cyclonic separating apparatus, comprising:

a cyclonic separator for separating dirt and dust from an airflow, an inlet to the cyclonic separator and a shroud comprising a wall having a plurality of through-holes forming an outlet from the cyclonic separator;

a plurality of separate passageways provided immediately downstream of the through-holes;

a further cyclonic separator provided downstream of the cyclonic separator, and an intermediate cyclonic separator provided downstream of the cyclonic separator and upstream of the further cyclonic separator.

17. The cyclonic separating apparatus of claim 16, wherein the intermediate cyclonic separator is located inwardly of the passageways.

18. The cyclonic separating apparatus of claim 16, wherein the intermediate cyclonic separator has a collector for collecting separated dirt and dust.

19. The cyclonic separating apparatus of claim 16, wherein the passageways communicate with an inlet to the intermediate cyclonic separator.

20. The cyclonic separating apparatus of claim 19, further comprising a duct located upstream of the inlet to the intermediate cyclonic separator and being in communication with each of the passageways.

21. A cyclonic separating apparatus, comprising:

a cyclonic separator for separating dirt and dust from an airflow, an inlet to the cyclonic separator and a shroud comprising a wall having a plurality of through-holes forming an outlet from the cyclonic separator;

a plurality of separate passageways provided immediately downstream of the through-holes;

a further cyclonic separator provided downstream of the cyclonic separator and comprising a plurality of cyclones in parallel, and an intermediate cyclonic separator provided downstream of the cyclonic separator and upstream of the further cyclonic separator.

* * * * *